US012428256B2

(12) United States Patent
Dandekar et al.

(10) Patent No.: US 12,428,256 B2
(45) Date of Patent: Sep. 30, 2025

(54) SYSTEM FOR A PAPER FOLDING MACHINERY

(71) Applicants: Sanjay Madhav Dandekar, Pune (IN); Datta Hari Deshpande, Pune (IN)

(72) Inventors: Sanjay Madhav Dandekar, Pune (IN); Datta Hari Deshpande, Pune (IN)

( * ) Notice: Subject to any disclaimer, the term of this patent is extended or adjusted under 35 U.S.C. 154(b) by 727 days.

(21) Appl. No.: 17/755,737

(22) PCT Filed: Nov. 4, 2020

(86) PCT No.: PCT/IB2020/060353
§ 371 (c)(1),
(2) Date: May 6, 2022

(87) PCT Pub. No.: WO2021/053654
PCT Pub. Date: Mar. 25, 2021

(65) Prior Publication Data

US 2022/0388802 A1 Dec. 8, 2022

(30) Foreign Application Priority Data

Nov. 6, 2019 (IN) ..... 201921044995

(51) Int. Cl.
*B65H 45/12* (2006.01)
*B65H 7/06* (2006.01)

(52) U.S. Cl.
CPC ..... *B65H 45/12* (2013.01); *B65H 7/06* (2013.01); *B65H 2551/29* (2013.01)

(58) Field of Classification Search
CPC ..... B65H 45/12; B65H 45/142; B65H 7/06; B65H 7/08; B65H 7/10; B65H 2551/29; B65H 2301/331; B65H 29/52; B65H 2601/272
USPC ..... 270/45, 52.07, 52.08
See application file for complete search history.

(56) References Cited

U.S. PATENT DOCUMENTS

2013/0244848 A1 9/2013 Tobishima
2020/0346887 A1* 11/2020 Yamamoto ..... B65H 9/04

FOREIGN PATENT DOCUMENTS

JP 2018090404 A * 6/2018
WO WO2018198187 A1 11/2018
WO WO2019087354 A1 5/2019

OTHER PUBLICATIONS

Espacenet machine translation of JP2018090404A; https://translationportal.epo.org/emtp/translate/?ACTION=description-retrieval&COUNTRY=JP&ENGINE=google&FORMAT=docdb&KIND=A&LOCALE=en_EP&NUMBER=2018090404&OPS=ops.epo.org/3.2&SRCLANG=ja&TRGLANG=en (Year: 2018).*

* cited by examiner

*Primary Examiner* — Leslie A Nicholson, III
(74) *Attorney, Agent, or Firm* — Vani Moodley, Esq.

(57) ABSTRACT

The present invention provides a system 100 for a paper folding machinery 200. The paper folding machinery 200 includes a roller folding unit, a strip directing The strip directing unit 220 directs a strip 300 received from the roller folding unit 210 in a predefined direction and at least one folding unit 230 folds the strip 300 received from the strip directing 200 unit 220. The system 100 includes a detecting unit 20 and mounting units 30*a* & 30*b*. The detecting unit 20 detects misalignment of the strip 300 on the strip directing unit 220 and at least one folding unit 230. Each of the mounting unit 30*a* and 30*b* enables movements in at least one direction of the strip directing unit 220 and the folding unit 230 respectively mounted thereon for correcting the misalignment of the strip 300 thereon.

8 Claims, 10 Drawing Sheets

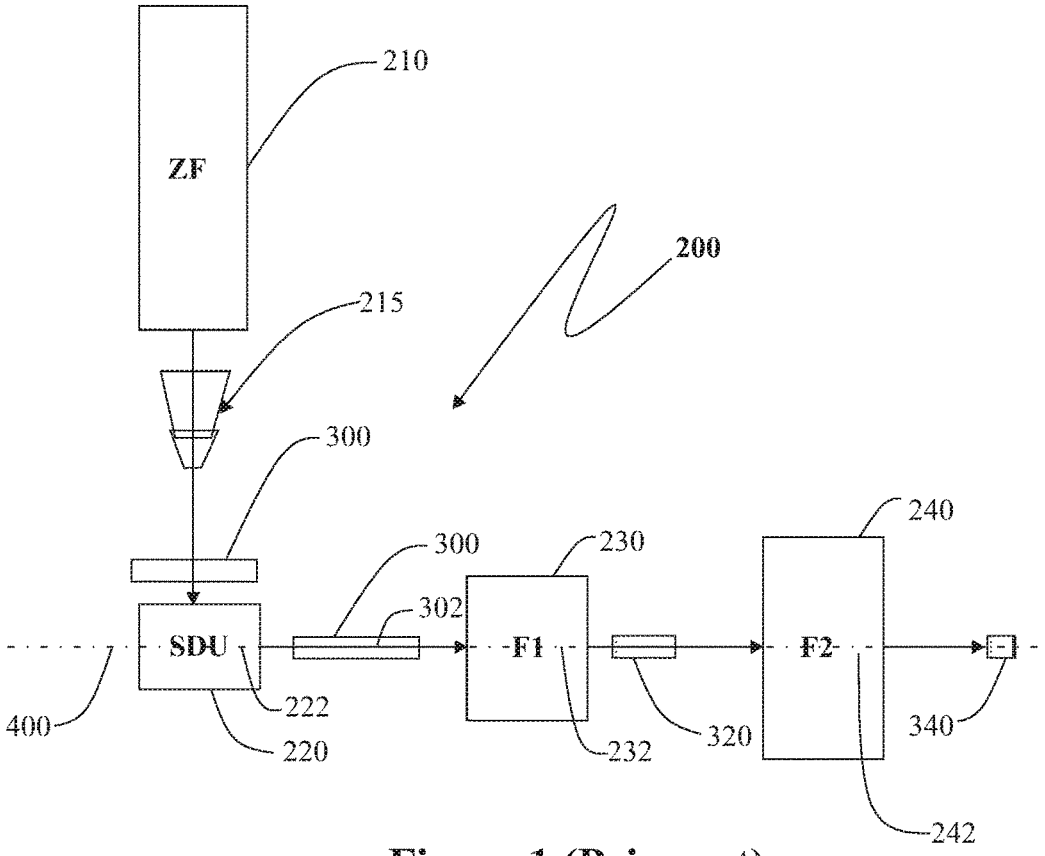
Figure 1 (Prior art)
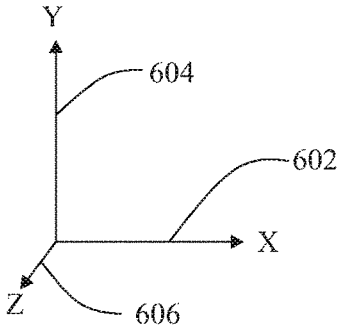

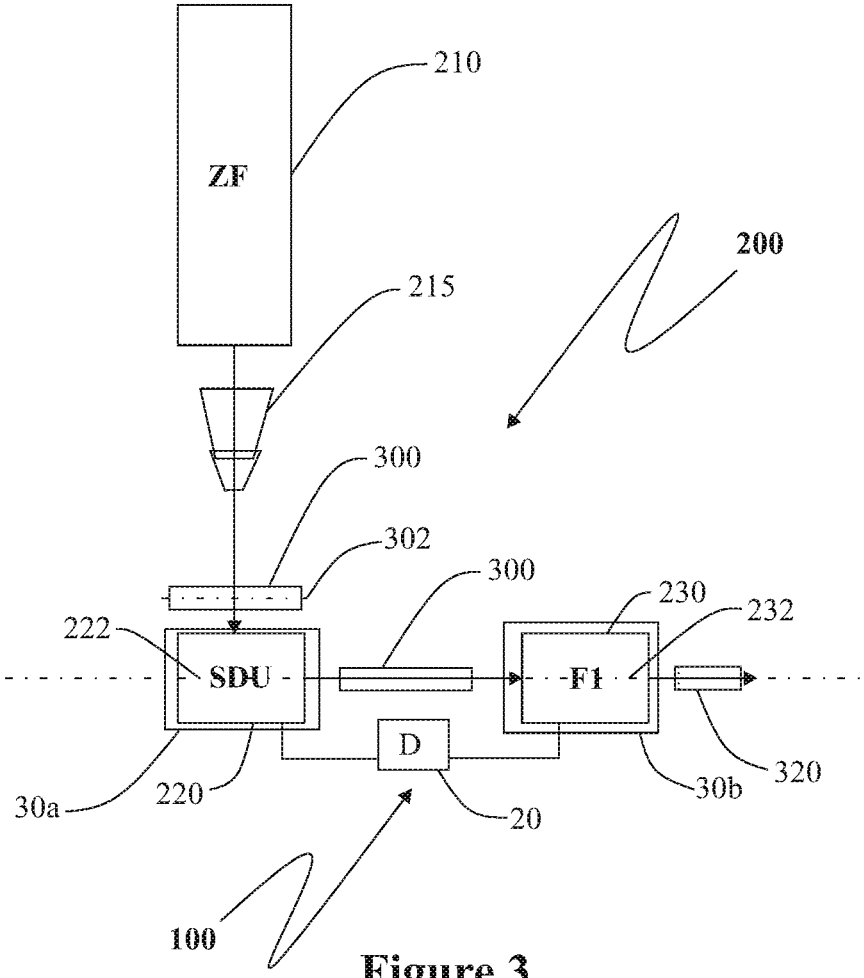
Figure 3
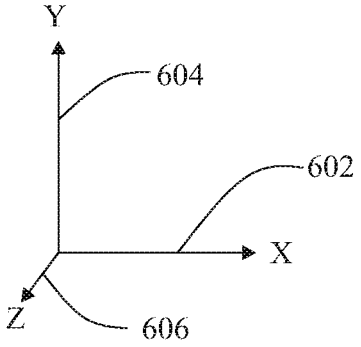

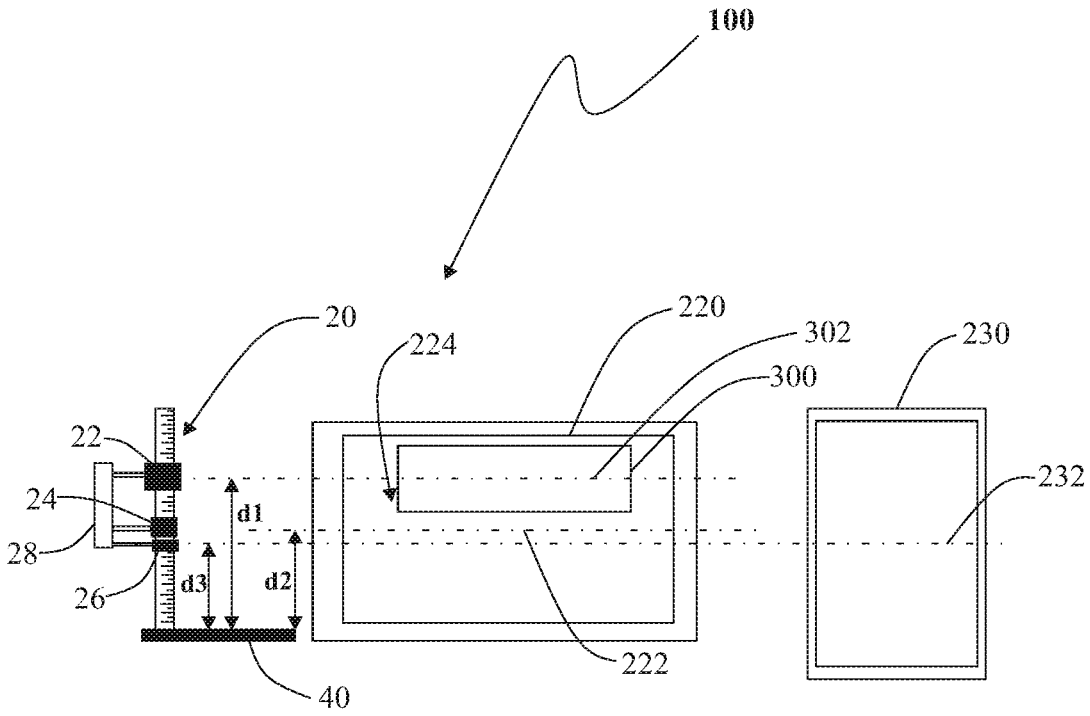
Figure 4
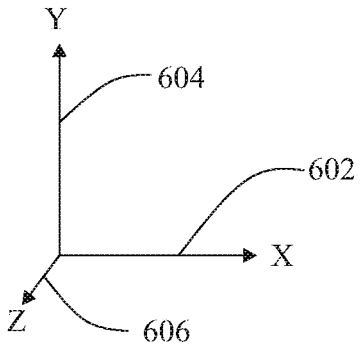

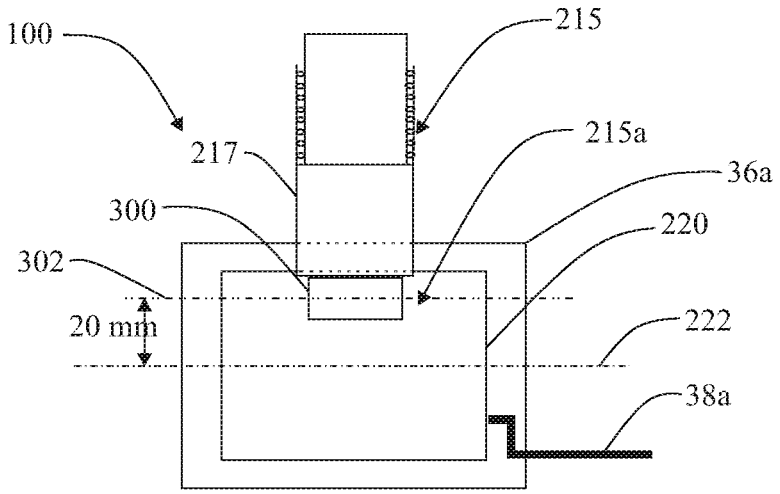
Figure 10a
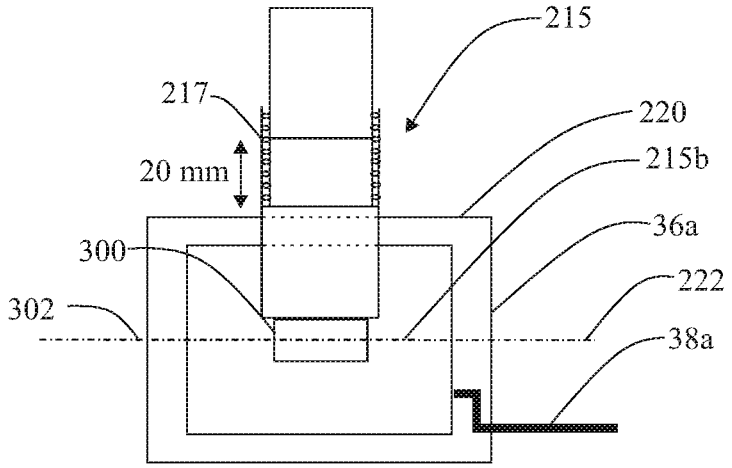
Figure 10b
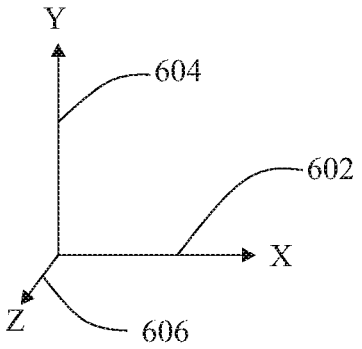

SYSTEM FOR A PAPER FOLDING MACHINERY

FIELD OF THE INVENTION

The present invention relates to a system for a paper folding machinery. More specifically, the present invention relates to a system for a paper folding machinery that produces pharmaceutical inserts & outserts or any such informational items.

BACKGROUND OF THE INVENTION

Pharmaceutical inserts & outserts are folded paper items having information related to medicines printed thereon (in). Generally, these inserts and outserts are first made as zigzag strips in a one direction and further folded to configure folded paper articles. Referring now to FIG. 1, a block diagram of an existing a paper folding machinery 200 for producing inserts & outserts is illustrated. The paper folding machinery 200 includes a roller folding unit (ZF) 210, strip delivering unit 215, a strip directing unit (SDU) 220, a first folding unit F1 230 and a second folding unit F2 240. These units are fixed to a ground surface.

A paper sheet 305 (FIG. 2*a*) having printed information thereon is fed to the roller folding unit 210. The roller folding unit 210 makes a paper strip 300 (refer FIG. 2*c*) with a zigzag pattern 310 (refer FIG. 2*b*) therein. The roller folding unit 210 is having a set of rollers for making the zigzag pattern 310 in the paper sheet 305. The paper strip 300 is received at the strip directing unit 220. The strip directing unit 220 directs the paper strip 300 to a set of units (230 & 240) arranged in a machine line (production line) 400. In the shown embodiment, the units (220, 230 & 240) are arranged horizontally inline or in any shape as desired. In other/existing machineries, the units (220, 230 & 240) in an "L" shape or "U shape" or such shapes according to the available of space for carrying out folding operations.

The first folding unit 230 folds the received paper strip 300 from the strip directing unit 220 to in a first fold direction to make a first folded article 320 (refer FIG. 2*d*). Further, the second folding unit 240 folds the first folded article 320 in a fold direction to make a second folded article 340 (add figure). Similarly, a plurality of folding units can be arranged in the paper folding machinery 200 for making different types of folded article. Generally, these folding units, 230 & 240 can be "knife folding machines" or "roller folding machines" or "press folding machine" which are commonly referred as so.

Generally for obtaining efficient folding of the paper strip 300, a centre line 302 of the paper strip 300 must be in line with a centre line of a unit. More specifically, the centre line 302 of the paper strip 300 must be in line with centre lines 222, 232, 242 of each machinery units 200 such as the strip directing unit 220, the first folding unit 230 and the second folding unit 240. The efficient folding here refers to folding of the articles without any folding errors. Generally, when a width "w" or a length "l" of the fed paper 305 or number of zigzag folds in the zigzag pattern 310 is alignment of the centre line 302 of the strip 300 with the centre lines 222, 232 of the units 220, 230 & 240 varies, thereby causing misalignments.

In order to obtain to overcome misalignments, each unit of the machinery 200 such as the strip directing unit 220, the first folding unit 230 and the second folding unit 240 are unfixed from the ground surface and moved in relevant direction (direction along X, Y Or Z axis) for aligning the centre lines of these units 220, 230, 240 with the centre line 302 of the strip 300. Shifting of these units is time consuming. Shifting of these units and for carrying further folding operations is tedious and increases a set-up time of the units folding operation.

Further, folding unit 230 generally includes a shaft having an elastic rings wrapped there around if the units are "roller folding machine". These elastic rings wear out over due to the folding operations. Generally, the shaft from the folding unit is replaced for carrying next folding operations. Removing and replacing the shaft from the folding units F1 or F2 and replacing the shaft is tedious and increases the set up time of the folding operations.

Therefore, there is a need for a system in the paper folding machinery 200 to overcome problems of the prior art.

OBJECTS OF THE INVENTION

An object of the present invention is to provide a system for a paper folding machinery; more specifically, a system for a paper folding machinery that produces inserts and outserts or any informational items.

Another object of the present invention is to provide system for a paper folding machinery for reducing the set up time for making a folded paper article by folding operations.

Still another object of the present invention is to provide a system for a paper folding machinery for facilitating easy adaptation of the units of the paper folding machinery with a change in dimension of the paper strip.

Further, an object of the present invention is to provide a system for a paper folding machinery which is simple in construction and easy in operation.

Furthermore, an object of the present invention is to provide a system for a paper folding machinery for reducing the events of effort in removing a shaft from a folding unit for and replacing the shafts with worn rings wrapped therearound.

SUMMARY OF THE INVENTION

According to the present invention, there is provided a system for a paper folding machinery. The paper folding machinery includes a roller folding unit, a strip delivering unit, a strip directing unit and at least one folding unit. The roller folding unit is capable of folding a paper sheet into a strip. The Strip delivering unit is arranged at the end of to the strip folding unit. Strip directing unit is connected to the roller folding unit with a strip delivering unit there between. The strip directing unit directs the received strip from the roller folding unit in a predefined direction. The at least one folding unit folds the strip received from the strip directing unit.

The system includes a detecting unit and mounting units. The detecting unit detect a misalignment of the strip on the strip directing unit and also on the at least one folding unit. In an embodiment, the detecting unit includes a first scale, a second scale and a third scale and a display. The first scale measures a first distance between a centre line of the strip on the strip directing unit and a reference along the at least one direction. The second scale measures a second distance between a centre line of the strip directing unit and the reference. The third scale measures a third distance between a centre line of the at least one folding unit and the reference. The difference between the second distance and the first distance; the third distance and the first distance is displayed as the misalignments of the strip directing unit and the folding unit respectively though a display of the detecting unit.

In an alternative embodiment, the detecting unit detects the misalignments electronically or optically. The mounting units are configured for mounting the strip directing unit and the at least one folding unit thereover. The each of the mounting unit enables movements in at least one direction of the strip directing unit and the at least one folding unit respectively for correcting the misalignment of the strip thereon.

More specifically, each of the mounting unit includes a fixed base, a movement facilitator and a movable frame. The fixed base is rigidly arranged to the ground surface. The movement facilitator is arranged on the fixed base. The movement facilitator is a rack and a pinion arrangement or a lead screw arrangement or a hydraulic or a pneumatic drive or a worm drive or and the like. Further, the movement facilitator is connected to an operating member.

The movable frame is connected to the movement facilitator. The strip directing unit or the at least one folding unit is mounted on the respective movable frame of the respective mounting unit. Upon operating the operating member to a predefined operation position, the movement facilitator moves the movable frame up to a predefined distance in an at least one direction, thereby moving the strip directing unit or the at least one folding unit up to the predefined distance in the at least one direction. The at least one direction is a length direction or a width direction or a height direction. The operating member is operated mechanically or electrically for moving the strip directing unit or the at least one folding unit for correcting the misalignment of the strip thereon.

Further, the system includes a locking arrangement for locking the movements of the moving units in other directions except in the one direction. In an alternative embodiment, the strip delivering unit or strip delivering unit includes an adjustable delivery end. The delivery end can be adjusted to change a delivery location of the strip on the strip directing unit, in at-least one direction.

BRIEF DESCRIPTION OF THE DRAWINGS

The advantages and features of the present invention will be understood better with reference to the following detailed description of some embodiments of the and claims taken in conjunction with the accompanying drawings, wherein like elements are identified with like symbols, and in which;

FIG. 1, shows a schematic view of an existing paper folding machinery which produces outserts or inserts;

FIG. 3, shows a schematic view of a system configured in a paper folding machinery in accordance with the present invention;

FIG. 4, shows a schematic view of a detecting unit of the system shown in FIG. 3;

FIGS. 10*a* & 10*b* showing schematic views of a strip delivering unit of an alternative embodiment of a system for a paper folding machinery at various positions in accordance with the present invention.

DETAILED DESCRIPTION OF THE INVENTION

Figure 2A:
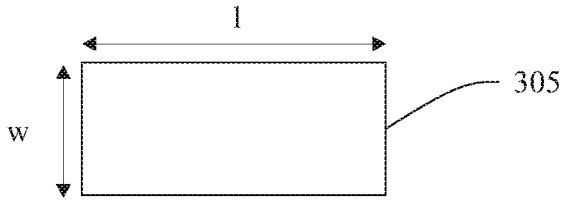
FIGS. 2*a*, 2*b*, 2*c*, 2*d* shows perspective views of different stages of the paper from a paper sheet to a folded article which are made in the existing paper folding machinery shown in FIG. 1.
Figure 2B:
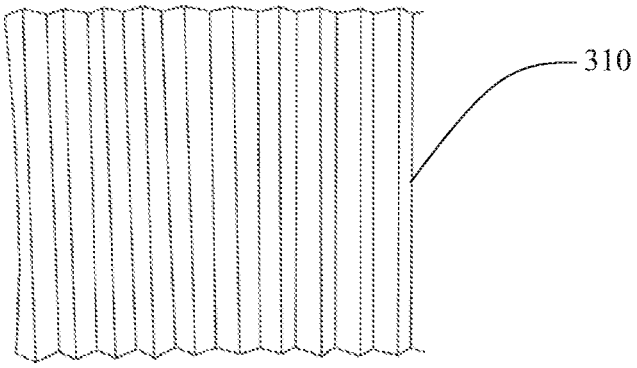
Figure 2C:
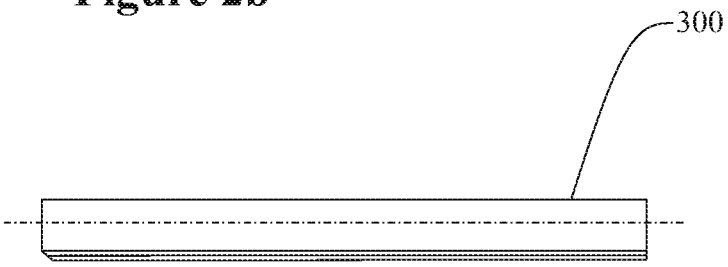
Figure 2D:
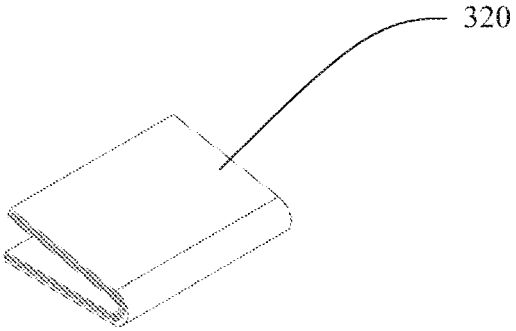

An embodiment of this invention, illustrating its features, will now be described in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

The terms "first," "second," and the like, herein do not denote any order, quantity, or importance, but rather are used to distinguish one element from another, and the terms "an" and "a" herein do not denote a limitation of quantity, but rather denote the presence of at least one of the referenced item.

The disclosed embodiments are merely exemplary of the invention, which may be embodied in various forms.

Referring now to FIG. 3, a schematic view of a system 100 configured in a paper folding machinery 200 in accordance with the present invention is illustrated. The paper folding machinery 200 includes a roller folding unit 210, a strip delivering unit 215, a strip directing unit 220 and at least one folding unit 230. The roller folding unit 210 is capable of folding a paper sheet 305 into a strip 300. The strip directing unit 220 is connected to the roller folding unit 210 with the strip delivering unit 215 therebetween. The strip directing unit 220 directs the received strip 300 from the roller folding unit 210 in a predefined direction. In the present embodiment, the predefined direction is along an X direction 602 as shown in FIG. 1. The strip directing unit 220 and the at least one folding unit 230 are arranged horizontally. In an alternative embodiment, the units 220 and 230 can be arranged in shape of "L" or "U" or in a circle or any such shapes as per the availability of space to the paper machinery 200. The X direction 602 is a length direction of the units 220 and 230.

The at least one folding unit 230 folds the strip 300 received from the strip directing unit 220 to configure a folded strip 320. In the present embodiment, the system 100 includes one folding unit 230. In an alternative embodiment, the system 100 may include two or three or four (more than one) folding units for carrying out series of folding operations for configuring inserts and outserts. In the present embodiment, there are different types of folding units 230 employed in the paper folding machinery 200. By way of non-limiting example, some of the types are knife fold type, roller fold type or press type and the like.

The system 100 includes a detecting unit 20 (refer FIG. 4) and mounting units 30*a* and 30*b*. The detecting unit 20 detects a misalignment of the strip 300 on the strip directing unit 220 and on the at least one folding unit 230. As the units are arranged horizontally in the shown embodiment, for making an efficient folding operations, a centre line 302 of the strip 300 needs to be in line with centre lines 222 and 232 of the strip directing unit 220 and the folding unit 230 respectively.

The detecting unit 20 includes a first scale 22, a second scale 24 and a third scale 26 and a display 28. The first scale measures a first distance (d1) between the centre line 302 of the strip 300 on the strip directing unit 220 at a position 224 and a reference 40 along an at least one direction. In this embodiment, the one direction can be along Y direction 604 as shown in FIG. 1. The reference 40 can be a fixed point or a position. The second scale 24 measures a second distance (d2) between the centre line 222 of the strip directing unit 220 and the reference 40. The third scale 26 measures a third distance (d3) between a centre line 232 of the at least one folding unit 230 and the reference 40. The difference between the second distance (d2) and the first distance (d1) is displayed as a misalignment of the strip directing unit 220 through the display 28 of the detecting unit 20. Similarly, the difference between the third distance (d3) and the first distance (d1) is displayed as a misalignment of the at least one folding unit 230 though the display 28 of the detecting unit 20.

In an alternative embodiment, the detecting unit 20 detects the misalignment electronically or optically and displays misalignments through an electronic or optical displays. It may be obvious to person skilled in the art to configure structural components of the detecting unit 20 for detecting misalignments of the units 220 and 230 with the strip 300. In the shown embodiment, the units are arranged in the line, the misalignments are displayed as magnitude of a distance along Y direction 604. In case the units are arranged in a "U" shape or the "L" shape or angular elevation or depressions, the misalignments are displayed as magnitude of distance in X, Y or Z direction or magnitude of angle or any such measurable factors which are obvious to a person skilled in the art.

Figure 5:
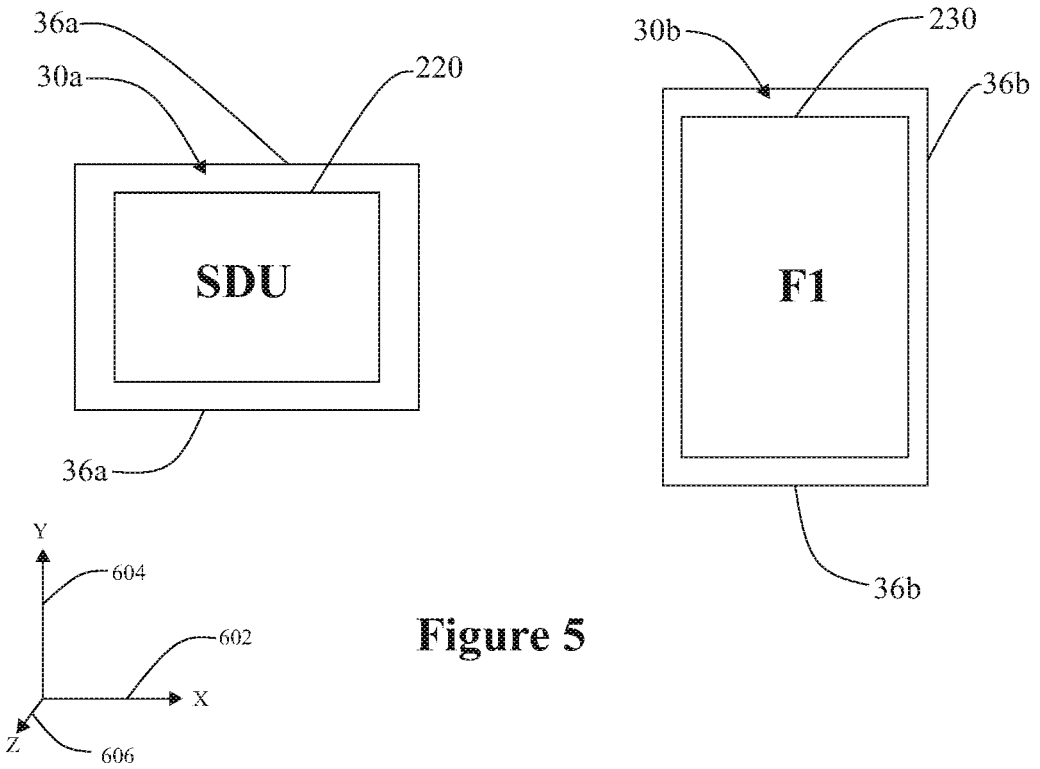
FIG. 5 and FIG. 6 show a top and front schematic view of units mounted on mounting units of the system shown in FIG. 3.
Figure 6:
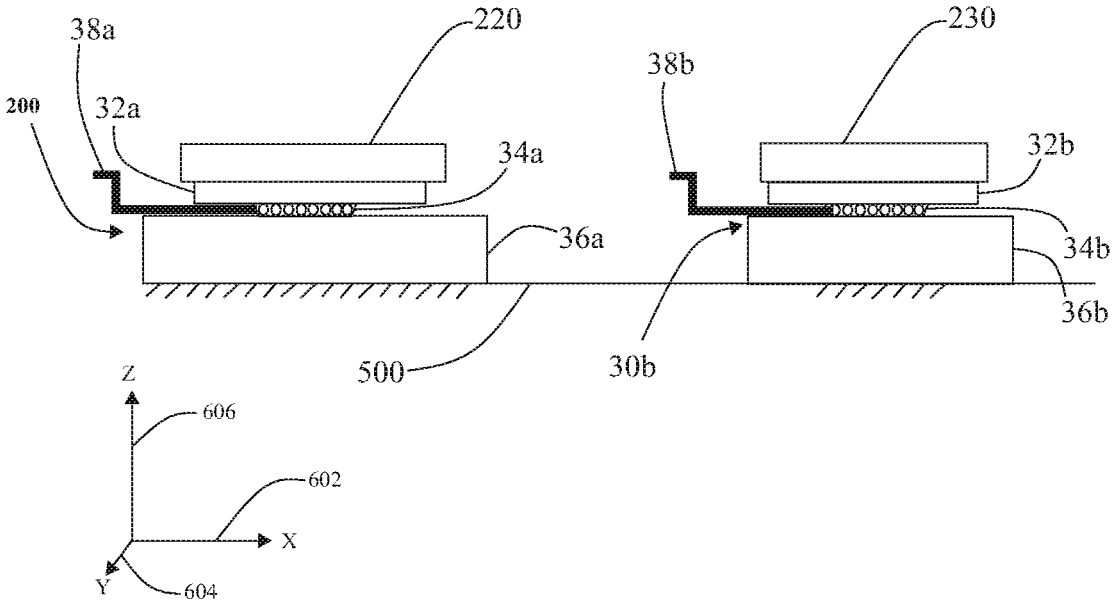

Referring now to FIGS. 5 and 6, a top and front schematic view of units 220 and 230 mounted on mounting units 30*a* and 30*b* of the system 100 in accordance with the present invention are illustrated. The mounting units 30*a* and 30*b* are configured for mounting the strip directing unit 220 and the folding unit 230 thereover. The each of the mounting unit 30*a* or 30*b* enables movements in an at least one direction of the strip directing unit 220 and the folding unit 230 respectively for correcting the misalignment of the strip 300 thereon.

More specifically, each of the mounting unit 30*a* and 30*b* includes a fixed base, a movement facilitator and a movable frame. The mounting unit 30*a* includes a fixed base 36*a*, a movement facilitator 34*a* and a movable frame 32*a*. Similarly, the mounting unit 30*b* includes a fixed base 36*b*, a movement facilitator 34*b* and a movable frame 32*b*. The fixed base 36*a* is rigidly arranged to the ground surface 500. The movement facilitator 34*a* is arranged on the fixed base 36*a*. The movement facilitator 34*a* is connected to an operating member 38*a*. In the present embodiment, the movement facilitator 34*a* is a rack and a pinion arrangement. In an alternative embodiment, the movement facilitator 34*a* can be a lead screw drive or a hydraulic or a pneumatic drive or a worm drive or any such arrangement facilitates relative movements therewith which is obvious to a person skilled in the art.

Further, the movable frame 32*a* is connected to the movement facilitator 34*a*. The strip directing unit 220 is mounted on the movable frame 32*a*. Similarly, the folding unit 230 is mounted on the movable frame 32*b*. It may be obvious to a person skilled in the art to configure the system 100 with mounting units 30*a*, 30*b*, 30*c* . . . 30*n* according to number of units needed to be mounted thereover.

Figure 7A:
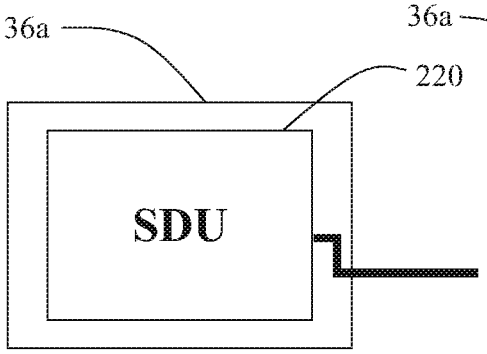
FIGS. 7*a*, 7*b*, 7*c*, 7*d*, 7*e*, 7*f* & 7*g* show schematic views of a strip directing unit mounted on a mounting unit shown in FIGS. 3, 5 & 6 at various positions.
Figure 7B:
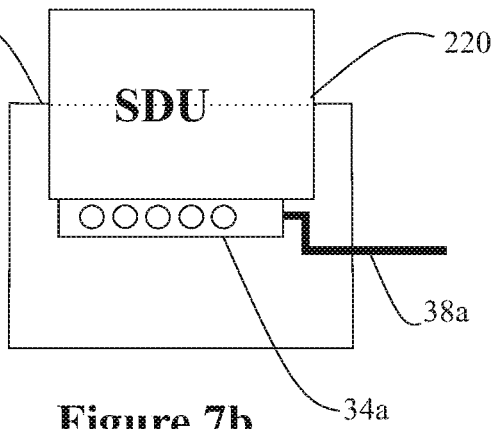
Figure 7C:
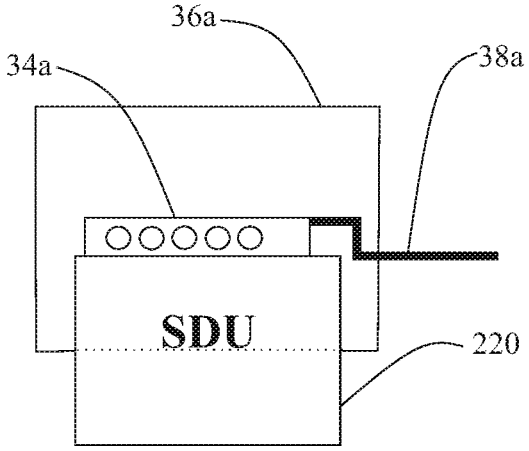
Figure 7D:
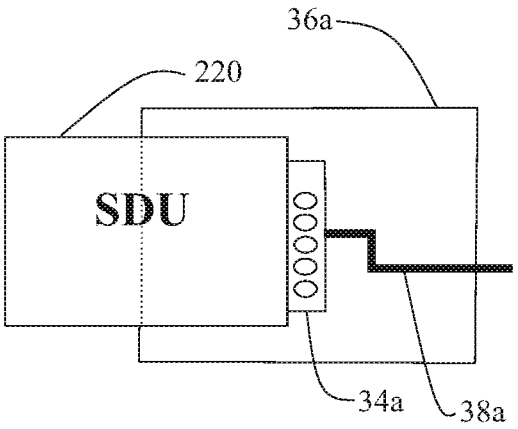
Figure 7E:
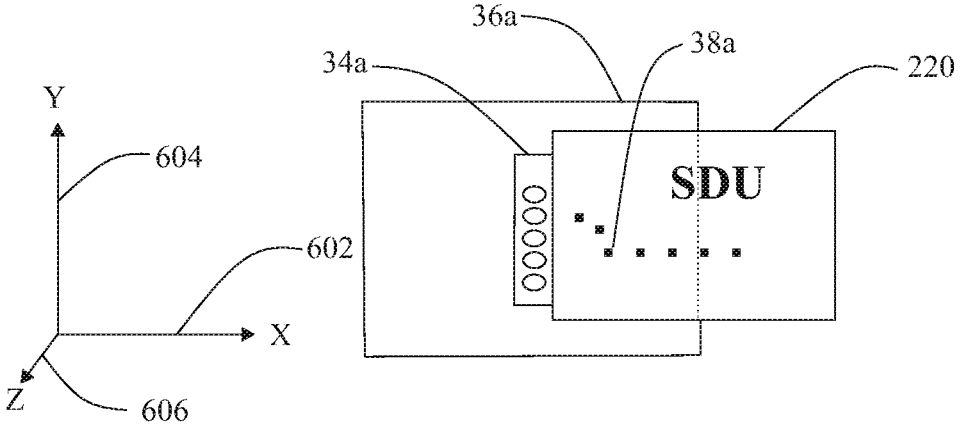
Figure 7F:
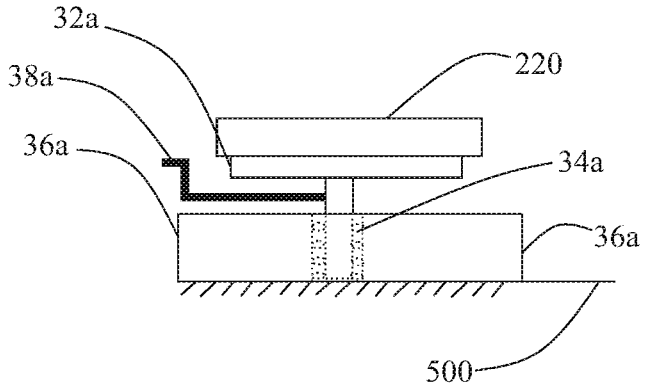
Figure 7G:
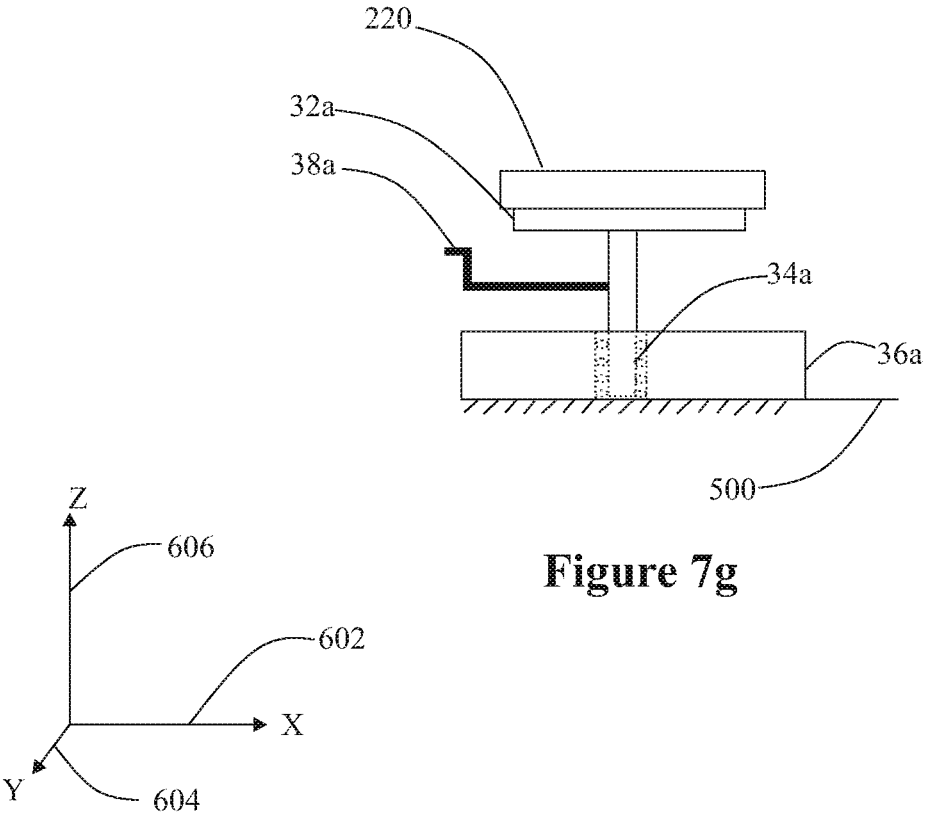

Furthermore, Upon operating the operating member 38*a* to a predefined operation position, the movement facilitator 34*a* moves the movable frame 32*a* up to a predefined distance in an at least one direction (refer FIGS. 7*b* and 7*c*). For example, if the operating member 38*a* is to be operated to a predefined operation position, the strip directing unit 220 is moved to a predefined distance in the at least one direction. The at least one direction can be along width direction of the strip directing unit 220. The width direction can be "Y" direction 604. In an alternative embodiment, the at least one direction is a length direction (X) (refer FIGS. 7*d* and 7*e*) 602 direction or a height direction (Z) direction 606 (refer FIGS. 7*f* and 7*g*). The movement facilitator 34*a* is configured to facilitate the movements of the strip directing unit 220 along X, Y and Z directions to various positions as shown in FIGS. 7*a*, 7*b*, 7*c*, 7*d*, 7*e*, 7*f* and 7*g*.

Figure 8A:
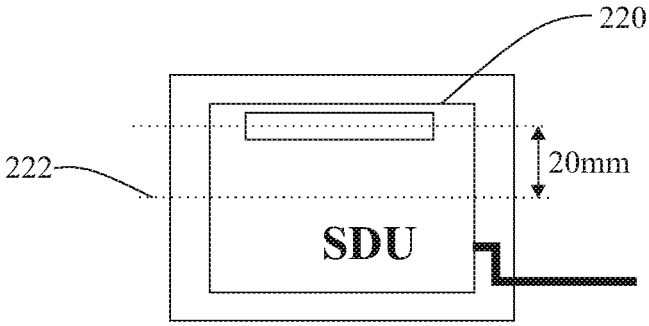
FIG. 8*a* shows a schematic view of the strip directing unit of the system with a misaligned position with the strip thereon in accordance with the present invention.
Figure 8B:
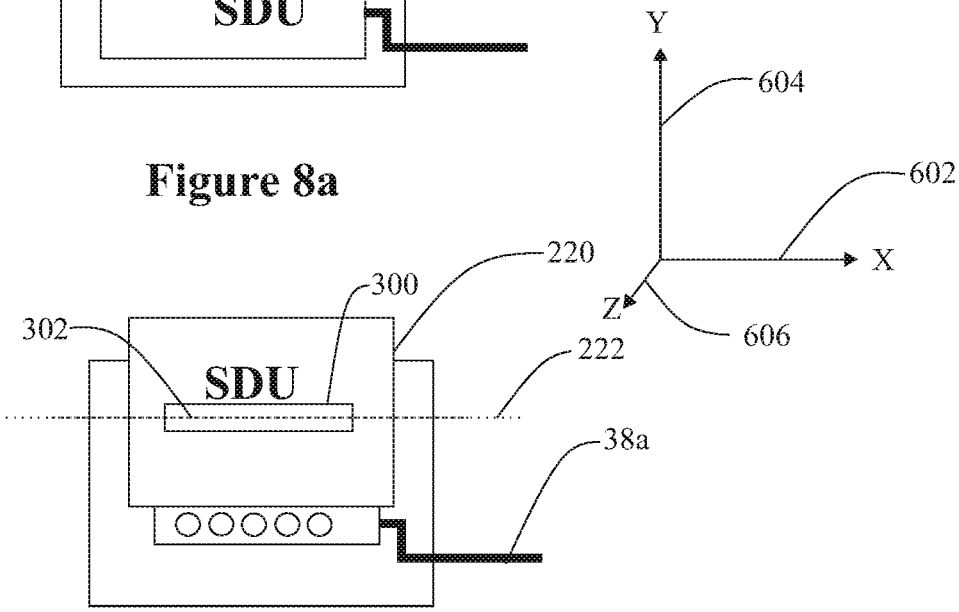
FIG. 8*b* shows a schematic view of the strip directing unit of the system 100 with an aligned position with the strip.

Referring now to FIGS. 8*a* and 8*b*, schematic views of the strip directing unit 220 of the system 100 at a misaligned position 220*a* and at an aligned position 220*b* with the strip 300 in accordance with the present invention are illustrated. The operating member 38*a* can be operated mechanically or electrically for moving the strip directing unit 220 for correcting the misalignment of the strip 300 thereon. For example, the detecting unit 20 detects the misalignment of "20 mm" in a Y direction 604 and displays the same through the display 28. The operating member 38*a* is operated mechanically or electrically to move the strip directing unit 220 by a "20 mm" on the mounting unit 30*a* in the Y direction 604 from the misaligned position 220*a* to the aligned position 220*b* as shown in FIGS. 8*a* and 8*b* respectively, thereby aligning the centre line 222 of the strip directing unit 220 with the centre line 302 of the strip 300.

Figure 9A:
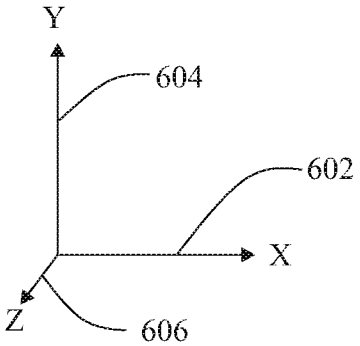
FIGS. 9*a*, 9*b* & 9*c* show line diagrams of various possible movements of the strip directing unit and the folding units of the system shown in 3, 5 & 6.
Figure 9B:
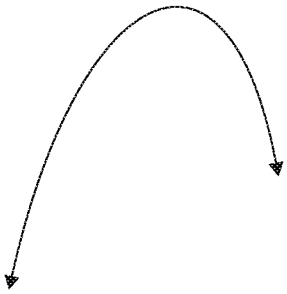
Figure 9C:
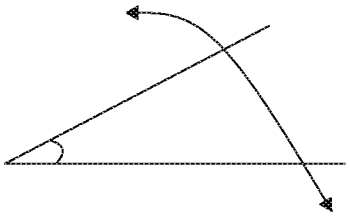

Similarly, the operating member 38*b* can be operated mechanically or electrically for moving the folding unit 230 for correcting the misalignment of the strip 300 thereon by aligning the centre line 232 of the folding unit 230 and the centre line of the strip 300. Similarly, by operating respective the operating members 38*a* or 38*b* of the units, the units can be moved in direction X 602, Y 604, Z 606 directions or combinations of these or in an arcade locus or angular deviation as shown in FIGS. 9*a*, 9*b*, and 9*c*. It may be obvious to person skilled in the art to configure the locus paths in the respective the movement facilitator 34*a* or 34*b* for moving the respective units 220 and 230 in moving paths (directions) as shown in 9*a*, 9*b* and 9*c*.

Further, the system 100 includes a locking arrangement (not shown) for locking the movements of the moving units 220 and 230 in other directions except in the at least one direction. For example, the strip directing unit 220 is moving the Y direction 604, the movements of the strip directing unit 220 are locked in X 602 and Z 606 direction. The locking arrangement can include a mechanical lock such as plunger or pin or hook or such locking elements which are obvious to a person skilled in the art.

Referring now to FIGS. 10*a* & 10*b*, schematic views of the strip delivering unit 215 of an alternative embodiment of a system 100 for the paper folding machinery 200 at various positions (215*a* and 215*b*) in accordance with the present invention are illustrated. In this embodiment, the strip delivering unit 215 includes an adjustable delivery end 217. The delivery end 217 can be adjusted in at least one direction to change a delivery location of the strip 300 on the strip directing unit 220. For example, if there is difference of 20 mm between the centre line 302 of the strip 300 and the centre line 222 of the strip directing unit 220 at a first buffer position 215*a*, the delivery end 217 can be adjusted by moving the delivery end 217 in Y direction 604 by 20 mm to a second delivery position 215*b* for aligning the centre line 302 of the strip 300 and the centre line 222 of the strip directing unit 220. Similarly, the strip delivering unit 215 can be configured to facilitate movements of the adjustable delivery end 217 in X 602, Y 604, Z 606 or angular directions for delivering the strip 300 at required locations for aligning the centre lines for correcting the misalignments.

Therefore, the present invention has an advantage of providing the system 100 in the paper folding machinery 200. More specifically the system 100 for system in the paper folding machinery 200 that produces inserts and outserts or any informational items. As there is no need to shift a location of the folding unit 240 by unfixing from the ground 500 for aligning the centre lines of the units with centre line 302 of the strip 300 (if changed), the a set-up time for folding operations is reduced, therefore, the system 100 is reducing cycle time for making a folded paper article by the folding operations. The system 100 facilitates easy adaptation of the units 220 & 230 in the paper folding machinery 200 with a change in dimension of the paper strip 300 by moving the strip directing unit 220 and the folding unit 230 according to misalignment detected by the detecting unit 20 for correcting the same. Further, the system 100 is simple in construction and easy in operation.

Figure 11A:
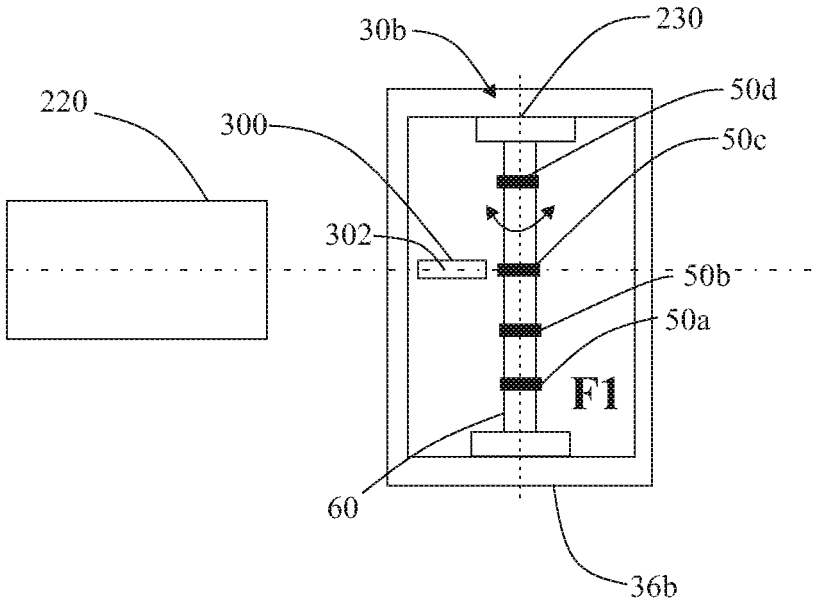
FIGS. 11*a* & 11*b* shows schematic views of a folding unit of the system shown in 3, 5 & 6 at various positions.
Figure 11B:
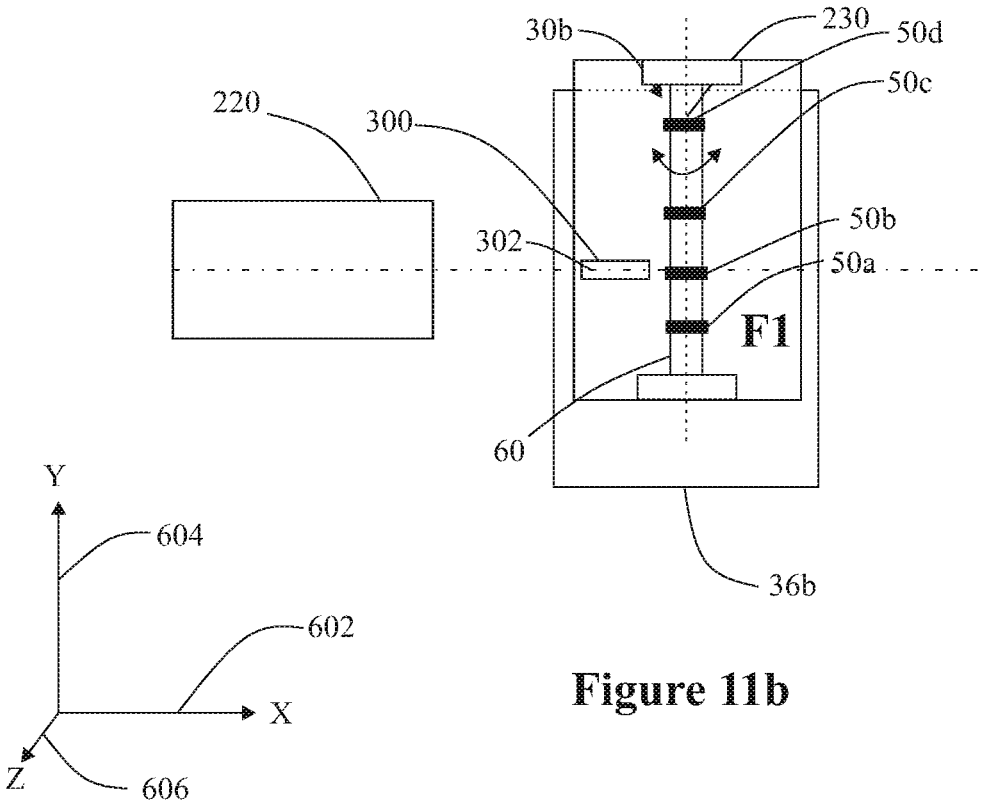

Referring now to FIGS. 11*a* and 11*b*, schematic views of the roller folding unit 230 of the system 100 at various positions in accordance with the present invention are illustrated. The folding unit 230 includes a shaft 60 having an elastic ring 50*c* for performing the folding operations of the strap 300. In the system 100, the shaft 60 can be wrapped with a plurality of elastic rings 50*a*, 50*b*, 50*c* and 50*d*. Upon wear out of a ring 50*c* (refer FIG. 11*a*), the folding unit 230 can be moved along Y direction 604 for aligning the ring 50*b* with the centre line 302 of the strip 300. The folding operations are continued until the ring 50*b* gets wear out. Similarly, the folding unit 230 can be moved along the Y direction 604 for aligning all rings 50*a*, 50*b*, 50*c* & 50*d* sequentially upon wearing out of each ring of the all rings 50*a*, 50*b*, 50*c* & 50*d*. Therefore, the system 100 reduces efforts for removing the shaft 60 from the folding unit 230 for replacing the same frequently, thereby decreasing or eliminating a down time and a re-set-up time, thereby reducing the set up time of the machinery.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and to thereby enable others skilled in the art to best utilise the present invention and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the scope of the claims of the present invention.

We claim:

1. A system for a paper folding machinery, the paper folding machinery includes a roller folding unit capable of folding a paper sheet into a strip, a strip directing unit connected to the roller folding unit with a strip delivering unit therebetween, the strip directing unit directs the received strip from the roller folding unit in a predefined direction and at least one folding unit for folding the strip received from the strip directing unit characterized in that the system comprises:

a detecting unit for detecting a misalignment of the strip on the strip directing unit and on the at least one folding unit; and mounting units for mounting the strip directing unit and the at least one folding unit thereover, each of the mounting unit and enables movements in at least one direction of the strip directing unit and the at least one folding unit respectively for correcting the misalignment of the strip thereon.

2. The system as claimed in claim 1, wherein the strip delivering unit includes an adjustable delivery end, the delivery end can be adjusted in at-least one direction to change a delivery location of the strip on the strip directing unit.

3. The system as claimed in claim 1, wherein the detecting unit includes:

a first scale for measuring a first distance between a centre line of the strip on the strip directing unit and a reference along the at least one direction;

a second scale for measuring a second distance between a centre line of the strip directing unit and the reference; and a third scale for measuring a third distance between a centre line 232 of the at least one folding unit and the reference, wherein the difference between the second distance and the first distance; the third distance and the first distance is displayed as the misalignments of the strip directing unit and the at least one folding unit respectively though a display of the detecting unit.

4. The system as claimed in claim 1, wherein the detecting unit detects the misalignment electronically or optically.

5. The system as claimed in claim 1, wherein the at least one direction is a length direction or a width direction or a height direction.

6. The system as claimed in claim 1, wherein each mounting unit comprises:

a fixed base rigidly arranged to the ground surface;

a movement facilitator arranged on the fixed base, the movement facilitator is connected to an operating member; a movable frame connected to the movement facilitator, the strip directing unit or the at least one folding unit is mounted thereover;

wherein, upon operating the operating member to a predefined operation position, the movement facilitator moves the movable frame up to a predefined distance in the at least one direction, thereby moving the strip directing unit or the at least one folding unit up to the predefined distance.

7. The system as claimed in claim 6, wherein the movement facilitator is a rack and a pinion arrangement.

8. The system as claimed in claim 6, wherein the operating member is operated mechanically or electrically for moving the strip directing unit or the at least one folding unit for correcting the misalignment of the strip thereon.

* * * * *